US008979252B2

(12) United States Patent
Okuda et al.

(10) Patent No.: US 8,979,252 B2
(45) Date of Patent: Mar. 17, 2015

(54) AGITATION KIT AND RECORDING APPARATUS

(71) Applicant: Seiko Epson Corporation, Tokyo (JP)

(72) Inventors: Ippei Okuda, Shiojiri (JP); Tsuyoshi Sano, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/775,705

(22) Filed: Feb. 25, 2013

(65) Prior Publication Data

US 2013/0222492 A1 Aug. 29, 2013

(30) Foreign Application Priority Data

Feb. 27, 2012 (JP) ..... 2012-039676

(51) Int. Cl.
*B41J 2/175* (2006.01)

(52) U.S. Cl.
CPC ..... *B41J 2/17533* (2013.01)
USPC ..... 347/86

(58) Field of Classification Search
USPC ..... 347/86
See application file for complete search history.

(56) References Cited

U.S. PATENT DOCUMENTS

| | | | | | |
|---|---|---|---|---|---|
| 3,481,712 | A | * | 12/1969 | Bernstein et al. | 422/548 |
| 3,691,086 | A | * | 9/1972 | Lees et al. | 516/142 |
| 4,113,911 | A | * | 9/1978 | LaFitte et al. | 442/401 |
| 4,156,244 | A | * | 5/1979 | Erikson et al. | 347/86 |
| 5,072,253 | A | * | 12/1991 | Patton | 355/40 |
| 5,513,747 | A | * | 5/1996 | Hayao | 206/232 |
| 5,630,868 | A | * | 5/1997 | Belmont et al. | 106/31.75 |
| 2004/0008244 | A1 | * | 1/2004 | Tsujimoto | 347/105 |
| 2009/0079802 | A1 | * | 3/2009 | Ito | 347/85 |

FOREIGN PATENT DOCUMENTS

| | | |
|---|---|---|
| JP | 2002-200764 | 7/2002 |
| JP | 2005-262823 | 9/2005 |
| JP | 2009-045944 | 3/2009 |

OTHER PUBLICATIONS

Roland DG Corporation, "XC-540W", For Owners of the XC-540W (White-ink Model) User's Manual, 2007, pp. 1-7).
Epson America, Inc., "Epson Stylus Pro WT7900", User's Guide, 2010, pp. 1-135.

* cited by examiner

*Primary Examiner* — Stephen Meier
*Assistant Examiner* — Alexander D Shenderov
(74) *Attorney, Agent, or Firm* — Harness, Dickey & Pierce, P.L.C.

(57) ABSTRACT

An agitation kit includes an information-written medium and a liquid container. The liquid container contains a dispersion medium and settleable particles. The information-written medium includes information on a manner of agitating the particles in the dispersion medium.

13 Claims, 1 Drawing Sheet

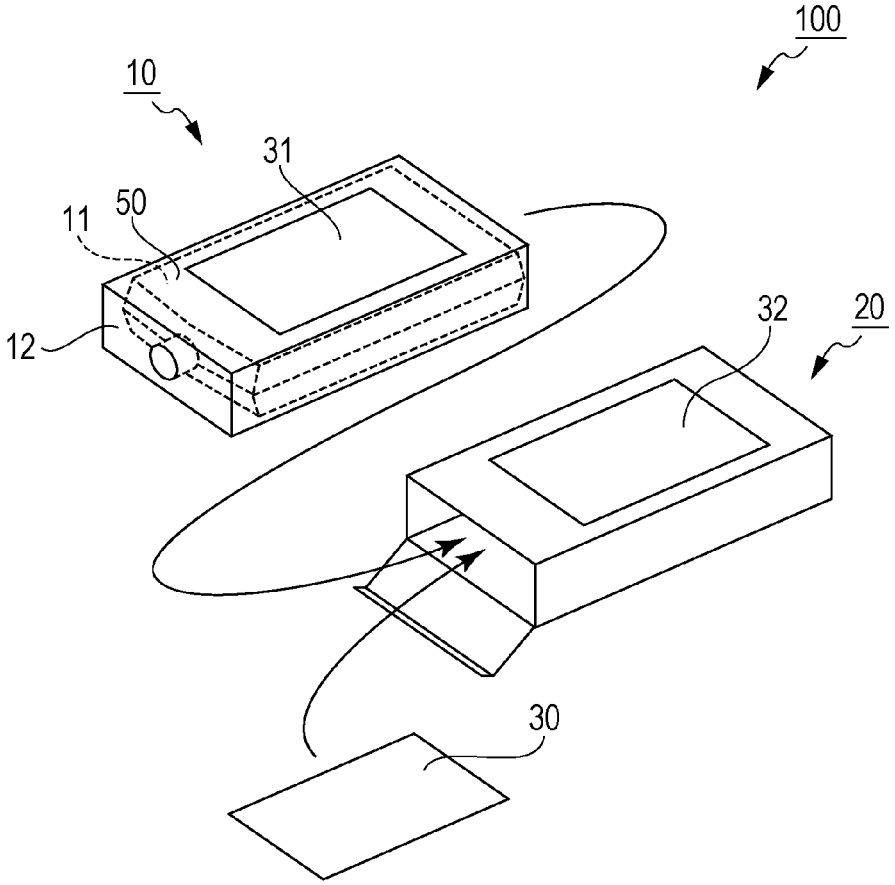
100
10
31
11
50
12
32
20
30

AGITATION KIT AND RECORDING APPARATUS

Priority is claimed under 35 U.S.C. §119 to Japanese Application No. 2012-039676 filed on Feb. 27, 2012, which is hereby incorporated by reference in its entirety.

BACKGROUND

1. Technical Field

The present invention relates to an agitation kit including an information-written medium and a liquid container, and to a recording apparatus including the agitation kit.

2. Related Art

Many of the inks used in ink jet recording apparatuses are mixtures in which particles of, for example, a pigment are uniformly dispersed in a dispersion medium. If such an ink is left standing for a long time, the dispersed particles, whose specific gravity is generally higher than that of the dispersion medium, are liable to settle. Settling of the dispersed particles often results in color nonuniformity, ink clogging or ejection failure of the recording apparatus, degraded recording quality and other problems. In order to prepare an ink in which particles are uniformly dispersed to some extent, some proposals to provide an ink agitation mechanism are made. For example, JP-A-2009-45944 proposes an agitation technique in which a stirring ball is placed in an ink cartridge.

In this technique, however, if the user of the ink cartridge continues to use the ink cartridge without recognizing the necessity to agitate the ink, recording quality is not improved. More specifically, if recording is performed after the ink cartridge is left neglected for a long time without being agitated even though the ink cartridge equipped with a stirring ball is used and the ink needs to be agitated, problems, such as color nonuniformity, ink clogging, or ejection failure, are likely to occur.

SUMMARY

The invention has been made to solve at least part of the above issues, and the following embodiments, or applications, of the invention can be provided.

Application 1

According to an aspect of the invention, an agitation kit is provided which includes a liquid container containing settleable particles and a dispersion medium, and an information-written medium on or in which a manner of agitating the particles in the dispersion medium is written. The manner of agitating including at least any one of a shaking manner of shaking the liquid container, an inverting-leaving manner of inverting the liquid container and leaving the liquid container inverted, and an inverted agitation manner of inverting the liquid container and agitating the liquid container in the inverted position. The shaking manner includes a manner of applying a predetermined negative acceleration to the liquid container. The inverting-leaving manner includes information on an inverting-leaving interval at which the inverting-leaving manner is performed, and the inverted agitation manner includes information on an inverted agitation interval at which the inverted agitation is performed.

Application 2

The manner of agitating may include the inverted agitation manner, and the inverted agitation interval satisfies at least one of the following relationships (1) and (2):

$$H/v>T; \text{ and} \quad (1)$$

$$H/6v<T. \quad (2)$$

In the relationships, T represents the inverted agitation interval, H represents the maximum internal height in the vertical direction of the liquid container when left in a state, and v represents the settling velocity of the particles in the dispersion medium, calculated from Stokes' law.

When the inverted agitation interval T satisfies the relationship T>H/6v in the manner of agitating the liquid container in an inverted position, settled particles moves at least one-sixth of the maximum internal height in the vertical direction of the liquid container when left in a state. Also, by setting the inverted agitation interval T so as to satisfy the relationship T<H/v, the particles can be prevented from settling to the extent that agitation is required again. Thus, agitation is performed as required. For the use of the ink container, the user can easily obtain more effective information on inverted agitation. Consequently, problems such as color nonuniformity, ink clogging, and dejection failure, can be reduced.

Application 3

The liquid container may include a liquid container bag containing the dispersion medium and the particles. The ratio of the volume of the dispersion medium to the volume of the liquid container bag is 95% immediately after charging the liquid container bag with the dispersion medium.

In this instance, convention occurs easily in the liquid in the liquid container bag by shaking or inverting the liquid container bag. Thus, the particles that tend to settle can be dispersed in the dispersion medium effectively. Consequently, problems such as color nonuniformity, ink clogging, and dejection failure, can be reduced.

Application 4

According to another aspect of the invention, a recording apparatus including the agitation kit is provided.

The recording apparatus includes the agitation kit having an information-written medium on which how to agitate the liquid container used is written. Therefore, the user can obtain necessary information on the manner of agitation. Consequently, problems such as color nonuniformity, ink clogging, and dejection failure, can be reduced.

BRIEF DESCRIPTION OF THE DRAWINGS

The invention will be described with reference to the accompanying drawing, wherein like numbers reference like elements.

FIGURE is a perspective view of a liquid container including an information-written medium according to an embodiment of the invention.

DESCRIPTION OF EXEMPLARY EMBODIMENTS

Embodiments of the invention will now be described.

First Embodiment

An agitation kit according to an embodiment of the invention will first be described. FIGURE is a perspective view of an ink cartridge (liquid container) kit 100 including an information-written medium and a liquid container. An embodiment, the ink cartridge kit 100 may include an ink cartridge 10 that is a liquid container and an operation manual 30 that is an information-written medium, and optionally a package box 20.

The ink cartridge 10, which is an example of the liquid container, may be an ink bag in the form of a bag without including a cartridge enclosure 12. The cartridge 10 in which an ink to be supplied to an ink jet recording apparatus will be placed may include an ink bag 11, a cartridge enclosure 12 and a label 31. The ink bag 11 contains an ink 50. The label 31 includes explanatory information on the ink cartridge 10, written thereon.

The package box 20 is intended to accommodate the ink cartridge 10, the operation manual 30 and so forth therein, and has an explanatory information-written portion 32 on the external surface thereof. On the explanatory information-written portion 32, information on the ink-cartridge kit 100 is written.

Examples of the information-written medium of the ink cartridge kit 100 include the operation manual 30, the label 31, and the explanatory information-written portion 32.

The ink 50 is a recording ink containing dispersed particles in a predetermined concentration. The constituents of the ink, including the particles, additives and solvent or dispersion medium, are selected according to the use of the ink. For dispersed particles of a white pigment, metal oxide particles or hollow resin particles may be used. Metal oxides for the white pigment include titanium dioxide, zinc oxide, silica, alumina, magnesium oxide, and zirconium oxide. Glittering pigments include metal particles, such as those of aluminum, silver, gold, platinum, nickel, chromium, tin, zinc, indium, titanium, and a copper, and pigments exhibiting pearly gloss or interference gloss, such as titanium dioxide-coated mica, fish scale foil, and bismuth oxychloride.

In general, these particles have a higher density than the dispersion medium in a dispersion, and are likely to settle if the dispersion is allowed to stand for a long time. The settling of dispersed particles causes color nonuniformity, ink clogging, and ejection failure in the recording medium, and may result in degraded recording quality. Accordingly, the ink 50 needs to be agitated effectively before use. In addition, metal oxides, such as titanium dioxide, that has settled for a long time are liable to be solidified (to form hard cake) at the bottom and cannot be easily dispersed again by agitation. Accordingly, the information-written medium of the ink cartridge kit 100 includes information of how to agitate the ink as below.

Information on Agitation Manner

1. Agitation Manners

Agitation for dispersing particles in a dispersion medium (hereinafter simply referred to as agitation) can be performed in various manners, according to the constituents of the ink, the form of the ink cartridge, the specifications of the recording apparatus and so forth. For example, the agitation is performed by shaking the ink cartridge, inverting the ink cartridge and leaving the cartridge inverted (hereinafter referred to as inverting-leaving), inverting the ink cartridge and agitating the ink cartridge in the inverted position (hereinafter referred to as inverted agitation), or applying vibration to the ink cartridge.

Some of these manners may be performed with an additional apparatus other than the recording apparatus, or may be performed by hand. The ink cartridge kit 100 includes information on a manner of agitation that may be performed by hand. The information on specific manners of agitation will now be described in detail.

1.1. Shaking Agitation

Agitation performed by shaking (hereinafter referred to as shaking agitation) is effective in the case where particles to be dispersed have a large difference in specific gravity (density) from the dispersion medium, in the case where the dispersion medium is easy to move in the ink bag 11, or in the case where a stirring bar having a relatively high specific gravity is placed in the ink bag 11 to help the agitation. Information for instructing the user on the shaking agitation includes at least any one of shaking direction, shaking width, shaking speed, and the number of times of shaking. Preferably, two types or more of information are written. Desirably, shaking speed is written.

The shaking direction refers to the direction in which the ink cartridge 10 is shaken, and a rough direction is written with respect to the position of the ink cartridge 10 shown in a figure.

The shaking width refers to the width at which the ink cartridge 10 is shaken, and a manner in which the width can be imagined or a rough width is written is written as the shaking width.

The shaking speed refers to the speed at which the ink cartridge 10 is shaken. A number of times per unit time of shaking at the shaking width or a manner in which the speed can be imagined is written.

Also, the information on the shaking agitation includes a manner of applying a predetermined negative acceleration to the ink cartridge 10. This is effective in the case where agitation must be performed more effectively, and is performed by, for example, abruptly stopping the operation (movement) of shaking the ink cartridge 10. More specifically, the ink cartridge 10 may be held in one hand and shaken from side to side so as to lightly hit the other hand.

The number of times of shaking refers to the number of times of shaking the ink cartridge 10, and may be represented by an approximate number or a time for which shaking is performed.

The results of evaluation example of the shaking agitation are shown in Table 1.

TABLE 1

| Shaking width (cm) | Speed (Number of times of reciprocal shaking/s) | Number of times of shaking | Evaluation |
|---|---|---|---|
| 5 | 1 | 50 | C |
| 15 | 1 | 30 | C |
| 15 | 1 | 50 | B |
| 15 | 1 | 100 | A |
| 30 | 1 | 50 | A |

Agitation was performed by shaking the ink cartridge 10 in the longitudinal direction thereof, in a state where an ink cartridge 10 was substantially horizontally held on a hand with the label 31 facing up, so as to lightly hit the other hand.

Evaluation criteria were as follows:

A: The difference in concentration from the uniformly dispersed state was 10% or less.

B: The difference was 20% or less.

C: The difference was 30% or less.

D: The difference was more than 30%.

It is advantageous that information on a manner of agitation is written with reference to the manner evaluated as A.

The ink cartridge used in the above evaluation example was the same as an ink cartridge (ink bag) for a printer PX-H 10000 (manufactured by Seiko Epson), and the liquid filling rate of the ink cartridge was 85%.

In the above example, a white ink having the composition shown in Table 2 was used, and the white pigment was a titanium dioxide dispersion prepared as below.

TABLE 2

| Constituent | (%) |
|---|---|
| White pigment (Titanium dioxide) | 10 |
| Polyester resin: KT-8803 produced by Unitika | 3 |

TABLE 2-continued

| Constituent | (%) |
|---|---|
| Polyethylene wax: PEM-17 produced by San Nopco | 1 |
| Surfactant: BYK 348 produced by BYK | 1 |
| Silica: Snowtex XL produced by Nissan Chemical | 1 |
| Propylene glycol | 10 |
| 1,2-Hexanediol | 3 |
| 2-Pyrrolidone | 2 |
| Ion exchanged water | Balance |

In a mixed solution containing 75% by mass of diethylene glycol diethyl ether, 25% by mass of a solid acrylic acid/n-butyl acrylate/benzyl methacrylate/styrene copolymer (glass transition temperature: 40° C., mass-average molecular weight: 10,000, acid value: 150 mg KOH/g) was dissolved to yield a polymer dispersant solution containing 25% by mass of solid resin.

To 36% by mass of the polymer dispersant solution, 19% by mass of diethylene glycol diethyl ether was added to prepare a resin varnish in which titanium dioxide would be dispersed. Then, 45% by mass of titanium dioxide (CR-90, treated with alumina silica (alumina/silica 0.5), average particle size (volume basis): 300 nm, oil absorption: 21 mL/100 g, produced by Ishihara Sangyo) was added to the resin varnish. After mixing and agitation, the titanium dioxide was dispersed in the mixture to yield a titanium dioxide dispersion in a wet circulation mill.

1.2. Inverting-Leaving, Inverted Agitation

Inverting-leaving is effective in the case where dispersed particles and the dispersion medium have a relatively large difference in density, or in the case where the settling velocity of dispersed particles is as high as 30 to 500 nm/s, such as 150 to 500 nm/s. Information for instructing the user on the manner of inverting-leaving includes the time interval of inverting-leaving. Preferably, the information further includes an inverting-leaving time.

The time interval of inverting-leaving refers to a standard interval at which suggestion for inverting-leaving is made. Also, the inverting-leaving time refers to a standard time for which the liquid container is left inverted.

Inverting-leaving is performed in such a manner that an ink cartridge 10 that has been neglected in a position in which a predetermined surface faces up is inverted by, for example, being turned upside down after a predetermined time period has elapsed, and is left inverted for a predetermined time. However, in an embodiment of the invention, the word "inverting" means that the liquid container or ink cartridge 10 is not only inverted 180° (upside down), but also inverted, for example, 90°, 270°, and such, and thus means that the liquid container is sufficiently tilted.

The time interval of inverting-leaving written on the information-written medium may be a week or more. Particles of pigments used in ink jet recording apparatuses generally have volume average particle sizes in the range of 200 nm to 2 μm. In the case of using such a pigment, it is desirable to agitate the liquid container or ink cartridge 10 by inverting the liquid container and leaving it inverted, after a week or more has elapsed. The time interval of the inverting-leaving is preferably in the range of one week to 12 months, such as in the range of 1 to 12 months or 3 to 12 months. A large part of the dispersed particles will settle for a week or more. Accordingly, it is desirable to suggest inverting-leaving. In particular, inverting-leaving is an effective countermeasure against hard cake produced by the settling of particles for a long time.

If an inverting-leaving time is written, it is preferably 30 minutes or more from the viewpoint of recovering from settling or hard cake. More preferably it is one hour or more.

Inverted agitation is a manner of agitation performed such that the ink cartridge 10 is shaken in a position in which a predetermined surface faces up and is then inverted so as to be shaken in a position in which another surface faces up.

An information-written medium on which suggestion for inverted agitation is written preferably includes information on the time interval of inverted agitation together. The time interval of inverted agitation refers to a standard interval at which suggestion for inverted agitation is made.

If a time interval of inverted agitation is written, it is preferably, but is not limited to, one day or more, such as in the range of 1 to 30 days.

Alternatively, the time interval of inverted agitation may be represented by, for example, the settling velocity of dispersed particles in the dispersion medium or the internal height of the ink bag 11 left in a certain state. The settling velocity of dispersed particles is calculated from Stokes' law:

$$V = \frac{(\rho - \rho w) g R^2}{18\ \eta}$$

In Stokes' low, v represents the settling velocity of dispersed particles, ρ represents the density of the dispersed particles, R represents the diameter of the dispersed particles, ρw represents the density of the dispersion medium, and η represents the viscosity of the dispersion medium. Also, g represents the gravitational acceleration. The time interval of inverted agitation, written on the information-written medium preferably satisfies relationship (1) H/v>T or relationship (2) T>H/6v, where T represents the time interval of inverted agitation, H represents the maximum internal height of the ink bag 11 left in a certain state, and v represents the settling velocity obtained from Stokes' low. More preferably, the time interval of inverted agitation satisfies the relationship H/v>T>H/6v. By setting the time interval of inverted agitation time so as to satisfy relationship (1), user's burden resulting from an excessively short interval is reduced. Also, by setting the time interval so as to satisfy relationship (2), dispersed particles are prevented from setting and solidifying during a long interval. The phrase "left in a certain state" applies to the state where the liquid container or ink cartridge is loaded in a recording apparatus.

It may be written that inverted agitation is certainly performed before use of the liquid container, instead of writing the time interval of inverted agitation. In this instance, inverted agitation is constantly performed, and thus recording can be performed using an ink having an appropriate density.

Table 3 shows physical properties of specific substances and their settling velocities calculated from Stokes' low.

TABLE 3

| Dispersed particles | Particle density ρ ($g/cm^3$) | Dispersion medium density ρw ($g/cm^3$) | Particle diameter R (cm) | Viscosity η (Pa · s) | Settling velocity (cm/s) |
|---|---|---|---|---|---|
| Titanium dioxide | 4.3 | 1.1 | 3.0E−05 | 0.004 | 3.9E−05 |
| Hollow resin | 1.09 | 1.04 | 6.0E−05 | 0.003 | 3.3E−06 |
| Color pigment | 1.6 | 1.04 | 1.0E−05 | 0.003 | 1.0E−06 |

For example, in the ink cartridge (ink bag) used for a recording apparatus PX-H10000 (manufactured by Seiko Epson), the maximum internal height is about 10 cm in the vertical direction of the ink cartridge when loaded in the recording apparatus. If this ink cartridge is filled with an ink containing titanium dioxide particles shown in Table 3, the time interval T of inverted agitation calculated from Stokes' low is about 3 days>T>about 0.5 day. It is desirable to write a time interval of inverted agitation within this range.

2. Information-Written Medium

Information on the manner of agitation may be written on or in various media. For example, the information may be printed in text on a sheet or label of paper or any other material, such as the operation manual 30, the label 31, or the information-written portion 32. Such text information may be converted into electronic signals and written in a media such as a compact disk (CD), a digital versatile disc (DVD) or flash memory. The information-written medium may be an instruction manual of a printer in which the ink cartridge is used. Instead of writing a detailed manner of agitation in text, the uniform resource locater (URL) of a web site in which information on the manner of agitation is shown may be written so that the information on the manner of agitation can be seen through the Net.

3. Examples of Written Information

Examples of written information of manners of agitation for the ink cartridge kit 100 will now be described. The following descriptions are written in or on each of the operation manual 30, the label 31 and the information-written portion 32.

EXAMPLE 1

Example 1 shows a manner of agitation in the case where shaking agitation is effective.

—Written Description—

After changing an ink cartridge for a new one, agitate the ink according to the following procedure before the changing.

Take a new ink cartridge out of a package, and agitate the ink cartridge before opening the sealed wrapper.

First, hold the ink cartridge in your hand as shown in the figure (not shown in the description herein), and sufficiently shake it using your wrist.

At this time, take care not to hit the ink cartridge against your surroundings, and carefully shake it at about a shoulder width.

Continue shaking the ink cartridge at a rate of twice a second for about one minute, and sufficient agitation will thus be completed.

After suspension for a while, agitate the ink before use, according to the following procedure.

Remove the ink cartridge from the printer, seal the open portion as shown in the figure (not shown in the description herein), and sufficiently shake the ink cartridge held in your hand using your wrist.

At this time, take care not to hit the ink cartridge against your surroundings, and carefully shake it at about a shoulder width.

Continue shaking the ink cartridge at a rate of twice a second for about one minute, and sufficient agitation will thus be completed.

EXAMPLE 2

Example 2 shows a manner of agitation in the case where inverting-leaving or inverted agitation is effective.

—Written Description—

For use after recording operation is suspended for one day or more, agitate the ink according the following procedure.

Remove the ink cartridge from the printer, and agitate the ink in a position in which the label of the ink cartridge faces up.

Then, invert the ink cartridge so that the label faces down, and agitate the ink cartridge again.

At this time, take care not to hit the ink cartridge against your surroundings.

Continue shaking the ink cartridge at a rate of twice a second for about one minute, and sufficient agitation will thus be completed.

After changing the ink cartridge for a new one, or before use after suspension for a while (more than about one month as a guide), agitate the ink according to the following procedure.

Remove the ink cartridge from the printer, and seal the open portion as shown in the figure (not shown in the description herein).

Then, place the ink cartridge on a flat portion in a position in which the label faces down, leave it in that position for about one hour, and agitate it.

The written description is not limited to the above examples, and includes at least any one of the shaking direction, shaking speed, shaking width and number of times of shaking, for shaking agitation, or further includes inverting-leaving interval, inverting-leaving time and inverted agitation interval, for inverting-leaving or inverted agitation. For the case where a predetermined negative acceleration is applied to the ink cartridge for agitation, the following descriptions can be written.

Hold the ink cartridge in one hand, and shake the ink cartridge using the wrist so as to lightly hit it against the other hand;

Hold the ink cartridge in one hand, and shake the ink cartridge using the wrist so as to abruptly stop the shaking; or Hold the ink cartridge in one hand, and shake the ink cartridge using a twist of the wrist so as to abruptly stop the shaking.

The descriptions need not be written in or on all of the operation manual 30, the label 31 and the information-written portion 32, and may be written in one or some of those media.

Liquid Container

The liquid container may be a packing bag. In this instance, the ink filling rate of the packing bag (volume ratio of the ink to the packing bag) is preferably 95% or less immediately after the packing bag is filled with an ink containing dispersed particles. More preferably it is in the range of 30% to 95%. The packing bag is preferably a pillow-like bag.

If the liquid container contain a liquid containing a coloring material (for example, a dye or an organic pigment having a small volume average particle size and a low specific gravity) having a lower settling velocity (based on Stokes' low) than the above-described dispersed particles, the liquid filling rate of the liquid container is preferably higher than the above case. This is because there is no need to reduce the filling rate when the liquid in the liquid container contains a coloring material less settleable, and the liquid container should be filled with as large an amount of liquid as possible. Thus, an appropriate liquid container can be prepared.

The effect of controlling the ink filling rate of the packing bag (ratio of the volume of the ink to the volume of the packing bag) was examined. The ink cartridge used for the examination was the same as a 700 mL ink cartridge (including an ink bag) for PX-H 10000 (manufactured by Seiko Epson), and was filled with the ink shown in Table 2. Ink bags of the Examples and Reference Example filled with the ink were allowed to stand under natural conditions for 5 months.

Then, each of the ink bags was agitated as below. The ink cartridge was horizontally held on a hand and reciprocally shaken 50 times in the longitudinal direction of the ink cartridge at a shaking width of about 15 cm and a speed of 3 times per second. Then, the ink cartridge was held upside down and was agitated again 50 times.

The effect of agitation was evaluated according to the criteria below. After agitation, aliquots of an ink (white ink composition), each in an amount of 10% of the initial amount of the ink in the ink cartridge, were taken one after another from the upper portion of the ink with a pump, and the rest of about 50 mL was left. Then, 1 g of each aliquot was taken out and diluted to 1000 times, and the thus prepared samples were measured for absorbance. More specifically, the absorbance of each diluted sample was measured at a wavelength of 500 nm with a spectrophotometer U-3300 manufactured by Hitachi.

For evaluation of the effect of agitation, the ratio of the absorbance of the sample to the absorbance of the white ink composition in the initial state (in which titanium dioxide white pigment particles were sufficiently dispersed with a concentration of 10%) was calculated. The absorbance ratio was thus calculated for each sample in which the particle concentration was varied by the settling of the white pigment, and the difference in absorbance ratio (highest absorbance ratio−lowest absorbance ratio) was evaluated. A large difference implies insufficient agitation.

Absorbance ratio [%]={(absorbance of sample)/(absorbance of ink in the initial state)}×100

Evaluation Criteria

A (excellent): 0 to less than 5%

B (good): 5% to less than 10%

C (fair): 10% to less than 40%

D (insufficient): 40% or more

Evaluation results are shown in Table 4.

TABLE 4

| | Filling amount | Filling rate | Highest absorbance ratio | Lowest absorbance ratio | Difference | Evaluation |
|---|---|---|---|---|---|---|
| Reference Example | 700 mL | 100% | 126% | 95% | 31% | C |
| Example | 600 mL | 86% | 102% | 99% | 3% | A |
| Example | 500 mL | 71% | 102% | 98% | 4% | A |

The liquid container including an information-written medium has the following effects.

Since the liquid container or ink cartridge 10 containing a settleable particles and a dispersion medium has an information-written medium in which a manner of agitating the particles are written, the user can easily refer to necessary information on the manner of agitation. Consequently, problems such as color nonuniformity, ink clogging, and dejection failure, can be reduced.

Also, for use of the ink cartridge 10 containing settleable particles and a dispersion medium, the user can easily obtain detailed information such as the shaking direction in which the ink cartridge 10 is shaken the shaking speed, the shaking width and the number of times of shaking as necessary information for agitation. Consequently, problems such as color nonuniformity, ink clogging, and dejection failure, can be reduced.

Also, for use of the ink cartridge 10 containing settleable particles and a dispersion medium, the user can easily obtain information such as a manner of applying a predetermined negative acceleration necessary for shaking and the like as necessary information for agitation. Consequently, problems such as color nonuniformity, ink clogging, and dejection failure, can be reduced.

Also, for use of the ink cartridge 10 containing settleable particles and a dispersion medium, the user can easily obtain information on a more effective manner of agitation such as the manner of inverting the ink cartridge 10 and leaving it inverted, the necessary time interval of inverting-leaving, and the manner of inverted agitation, and the necessary time interval of inverted agitation. Consequently, problems such as color nonuniformity, ink clogging, and dejection failure, can be reduced.

In the manners of agitation, performed by inverting the ink cartridge 10 containing settleable particles and a dispersant medium and leaving the cartridge inverted (inverting-leaving), or by agitating the ink cartridge 10 in an inverted position (inverted agitation), the time interval of inverting-leaving, the inverting-leaving time and the time interval of inverted agitation are desirably written. In the manner of agitation performed by agitating the ink cartridge 10 containing settleable particles and a dispersion medium in an inverted position, the time interval T of inverted agitation may satisfy the relationship $T>H/6v$. In this instance, settled particles move at least one-sixth of the maximum internal height in the vertical direction of the ink cartridge 10 left in a certain state. Also, by setting the inverted agitation interval T so as to satisfy the relationship $T<H/v$, the particles can be prevented from settling to the extent that agitation is required again. Thus, agitation is appropriately performed as required. The user can easily obtain more effective information on inverted agitation for the use of the ink cartridge 10. Consequently, problems such as color nonuniformity, ink clogging, and dejection failure, can be reduced.

The ink cartridge 10 containing settleable particles and a dispersion medium may have as a kit an information-written medium in or on which a manner of agitating the particles is written. In this instance, the user can easily obtain necessary information on the manner of agitation. Consequently, problems such as color nonuniformity, ink clogging, and dejection failure, can be reduced.

The liquid container may be a packing bag. In this instance, the ink filling rate of the packing bag (volume ratio of the ink to the packing bag) is preferably 95% or less, more preferably in the range of 30% to 95%, immediately after the packing bag is filled with an ink containing dispersed particles. Accordingly, when the packing bad is shaken before it is loaded in an ink jet recording apparatus or after it is removed from the ink jet recording apparatus, convection can occur easily in the ink in the packing bag. Consequently, the particles that tend to settle can be dispersed in the dispersion medium effectively. Thus, even though the liquid container is sealed and does not contain an air phase, it can be appropriately agitated without being equipped with a stirring ball therein. Therefore, the liquid container can be provided at a low cost.

The packing bag is preferably a pillow-like bag. Since pillow-like bags do not have folds forming gussets, unlike a gusset-type packing bag, settling particles will not be trapped in the gussets. Accordingly, the particles of the ink that tend to settle can be easily dispersed in the dispersion medium by producing convection in the ink.

Second Embodiment

A recording apparatus of an embodiment will now be described. The same parts as in the first embodiment are designated by the same reference numerals and thus description thereof is omitted. In a second embodiment, an ink jet recording apparatus will be described by way of example of the recording apparatus including the ink cartridge 100.

The starter kit of the ink jet recording apparatus includes an ink cartridge kit. Therefore, when the ink jet recording apparatus is used for the first time, there is no necessity of preparing an ink cartridge. In addition, the ink cartridge kit 100 includes information of how to agitate the ink cartridge used. Accordingly, for use of the ink jet recording apparatus of the present embodiment, the user can easily obtain necessary information on the manner of agitation. Consequently, problems such as color nonuniformity, ink clogging, and dejection failure, can be reduced.

Modification

The ink jet recording apparatus of the second embodiment includes a starter kit including the ink cartridge kit 100. However, the ink jet recording apparatus does not necessarily include an ink cartridge, and may have only an information-written medium including information on the manner of agitation. More specifically, the ink jet recording apparatus may include, for example, an operation manual 30 or the like in which information on a manner of agitating the ink is written, not including the ink cartridge kit 100.

Accordingly, for use of the ink jet recording apparatus of the modification, the user can easily obtain necessary information on the manner of agitation Consequently, problems such as color nonuniformity, ink clogging, and dejection failure, can be reduced.

What is claimed is:

1. An agitation kit comprising:

an ink cartridge containing an ink having settleable particles selected from the group consisting of pigments and hollow resin particles; and an information-written medium on or in which a manner of agitating the particles in the ink is written, the manner of agitating including either an inverting-leaving manner of inverting the ink cartridge and leaving the ink cartridge inverted or an inverted agitation manner of inverting the ink cartridge and agitating the ink cartridge in the inverted position, wherein the inverting-leaving manner includes information on an inverting-leaving interval at which the inverting-agitation manner is performed, and the inverted agitation manner includes information on an inverted agitation interval at which the inverted agitation is performed.

2. The agitation kit according to claim 1, wherein the manner of agitating includes the inverted agitation manner, and the inverted agitation interval satisfies at least one of the following relationships (1) and (2):

$$H/v>T, \text{ and} \quad (1)$$

$$H/6v<T, \quad (2)$$

wherein T represents the inverted agitation interval, H represents the maximum internal height in the vertical direction of the ink cartridge when left in a state, and v represents the settling velocity of the particles in the ink, calculated from Stokes' law.

3. A recording apparatus comprising the agitation kit as set forth in claim 2.

4. The agitation kit according to claim 1, wherein the ink cartridge includes a liquid container bag containing the ink and the particles, and the ratio of the volume of the ink to the volume of the liquid container bag is 95% immediately after the liquid container bag is filled with the ink.

5. A recording apparatus comprising the agitation kit as set forth in claim 4.

6. recording apparatus comprising the agitation kit as set forth in claim 1.

7. The agitation kit according to claim 1, wherein the information-written medium is a flash memory.

8. The agitation kit according to claim 1, wherein the information-written medium is a compact disc (CD).

9. The agitation kit according to claim 1, wherein the information-written medium is a digital versatile disc (DVD).

10. The agitation kit according to claim 1, wherein the pigment is selected from the group consisting of a white pigment and a glitter pigment.

11. The agitation kit according to claim 10, wherein the white pigment is a metal oxide.

12. The agitation kit according to claim 11, wherein the metal oxide is selected from the group consisting of titanium dioxide, zinc oxide, silica, alumina, magnesium oxide, and zirconium oxide.

13. The agitation kit according to claim 10, wherein the glitter pigment is selected from the group consisting of aluminum, gold, platinum, nickel, chromium, tin, zinc, indium, titanium, and copper.

* * * * *